US009661909B2

(12) United States Patent
Brunett

(10) Patent No.: US 9,661,909 B2
(45) Date of Patent: May 30, 2017

(54) FACIAL HAIR SHAPING TOOL

(71) Applicant: Michael Neil Brunett, Melbourne, FL (US)

(72) Inventor: Michael Neil Brunett, Melbourne, FL (US)

( * ) Notice: Subject to any disclaimer, the term of this patent is extended or adjusted under 35 U.S.C. 154(b) by 0 days.

(21) Appl. No.: 15/200,888

(22) Filed: Jul. 1, 2016

(65) Prior Publication Data

US 2016/0309876 A1 Oct. 27, 2016

Related U.S. Application Data

(63) Continuation of application No. 15/139,452, filed on Apr. 27, 2016, now abandoned, which is a continuation of application No. 14/928,118, filed on Oct. 30, 2015.

(60) Provisional application No. 62/122,918, filed on Nov. 3, 2014.

(51) Int. Cl.

| | |
|---|---|
| ***A45D 24/34*** | (2006.01) |
| ***A45D 24/36*** | (2006.01) |
| ***A45D 27/42*** | (2006.01) |
| ***A45D 24/02*** | (2006.01) |
| *A45D 24/42* | (2006.01) |

(52) U.S. Cl.

CPC ..... *A45D 24/36* (2013.01); *A45D 24/02* (2013.01); *A45D 27/42* (2013.01); *A45D 24/42* (2013.01)

(58) Field of Classification Search

CPC ..... A45D 24/36; A45D 24/34; A45D 27/42; A45D 27/00; A45D 44/00; A45D 24/42

See application file for complete search history.

(56) References Cited

U.S. PATENT DOCUMENTS

| | | | | |
|---|---|---|---|---|
| 1,615,408 | A * | 1/1927 | Scott | A45D 24/36 132/126 |
| 3,407,823 | A * | 10/1968 | Selvaggio | A45D 24/36 132/214 |
| 4,502,232 | A * | 3/1985 | Broders | A47G 27/0487 33/479 |
| 5,329,946 | A * | 7/1994 | Guma | A45D 27/00 132/213.1 |
| D384,297 | S * | 9/1997 | Paynes | D10/64 |
| 7,252,094 | B2 * | 8/2007 | Maynard | A45D 24/36 132/214 |
| D589,648 | S * | 3/2009 | Bakus | D10/71 |
| 7,559,331 | B2 * | 7/2009 | Ward | A45D 24/36 132/214 |
| 2007/0261709 | A1 * | 11/2007 | Bakus | A45D 44/00 132/214 |

(Continued)

*Primary Examiner* — Robyn Doan

(74) *Attorney, Agent, or Firm* — Jason T. Daniel, P.A.; Daniel Law Offices, P.A.

(57) ABSTRACT

A facial hair shaping tool includes a unitary and generally L-shaped main body having a shape that is designed to contour to the face of an adult human. The main body includes a front surface, a back surface, a top end, an elongated planar first side, an elongated bottom end, a truncated second side and a curvilinear central section that extends from the second side to the top end. The main body is constructed from a unitary mold of injected plastic having a longitudinal edge along the bottom end. A plurality of spaced apart combing teeth are cantileveredly mounted to the longitudinal edge at a perpendicular orientation to the longitudinal axis of the tool.

12 Claims, 5 Drawing Sheets

(56) References Cited

U.S. PATENT DOCUMENTS

| | | | | |
|---|---|---|---|---|
| 2009/0101160 | A1* | 4/2009 | Ruckart | A45D 24/04<br>132/136 |
| 2009/0223530 | A1* | 9/2009 | Chapman | A45D 27/42<br>132/200 |
| 2012/0234341 | A1* | 9/2012 | Kingery | A45D 27/42<br>132/214 |
| 2013/0213429 | A1* | 8/2013 | Allen | A45D 27/42<br>132/214 |

* cited by examiner

FACIAL HAIR SHAPING TOOL

CROSS-REFERENCE TO RELATED APPLICATIONS

This application claims the benefit of U.S. application Ser. No. 15/139,452 filed on Apr. 27, 2016; which is a continuation of U.S. application Ser. No. 14/928,118 filed on Oct. 30, 2015; and U.S. Application Ser. No. 62/122,918 filed on Nov. 3, 2014, the contents of each of which are incorporated herein by reference.

TECHNICAL FIELD

The present invention relates generally to grooming devices, and more particularly to a facial hair shaping tool.

BACKGROUND

The statements in this section merely provide background information related to the present disclosure and may not constitute prior art.

When shaving or trimming facial hair, men typically utilize one or more well-known cutting devices such as an electric razor, a manual shaving razor, scissors, and/or clippers, for example. Although such devices function well to remove hair from the face of the user, they do not discriminate with regard to the hairs they remove. As such, users must take care to trim only those areas in which they want facial hair removed.

Unfortunately, it is an all too common occurrence that men with facial hair do not know how to properly sculpt their facial hair to form clean symmetrical shapes. Although a user can style their facial hair into many different shapes, the challenge is to do it correctly. To this end, one of the most common issues when sculpting facial hair is trim each side of a beard, sideburns, goatee, and/or mustache to be symmetrical, so as to avoid an unbalanced look.

The present invention, directed to a facial hair shaping tool differs from all previously known cutting templates and other such devices in a number of aspects. The manner by which will become more apparent in the description which follows, particularly when read in conjunction with the accompanying drawings.

SUMMARY OF THE INVENTION

The present invention is directed to a facial hair shaping tool. One embodiment of the present invention can include a unitary and generally L-shaped main body having a shape that is designed to contour to the face of an adult human. The main body can include a front surface, a back surface, a top end, an elongated planar first side, an elongated bottom end, a truncated second side and a curvilinear central section that extends from the second side to the top end. A plurality of combing teeth are disposed along the bottom end, and function to engage the beard of a user.

In another embodiment, the main body is constructed from a unitary mold of injected plastic, having a longitudinal edge, and each of the combing teeth can be cantileveredly mounted to the longitudinal edge at a perpendicular orientation to the longitudinal axis of the tool.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
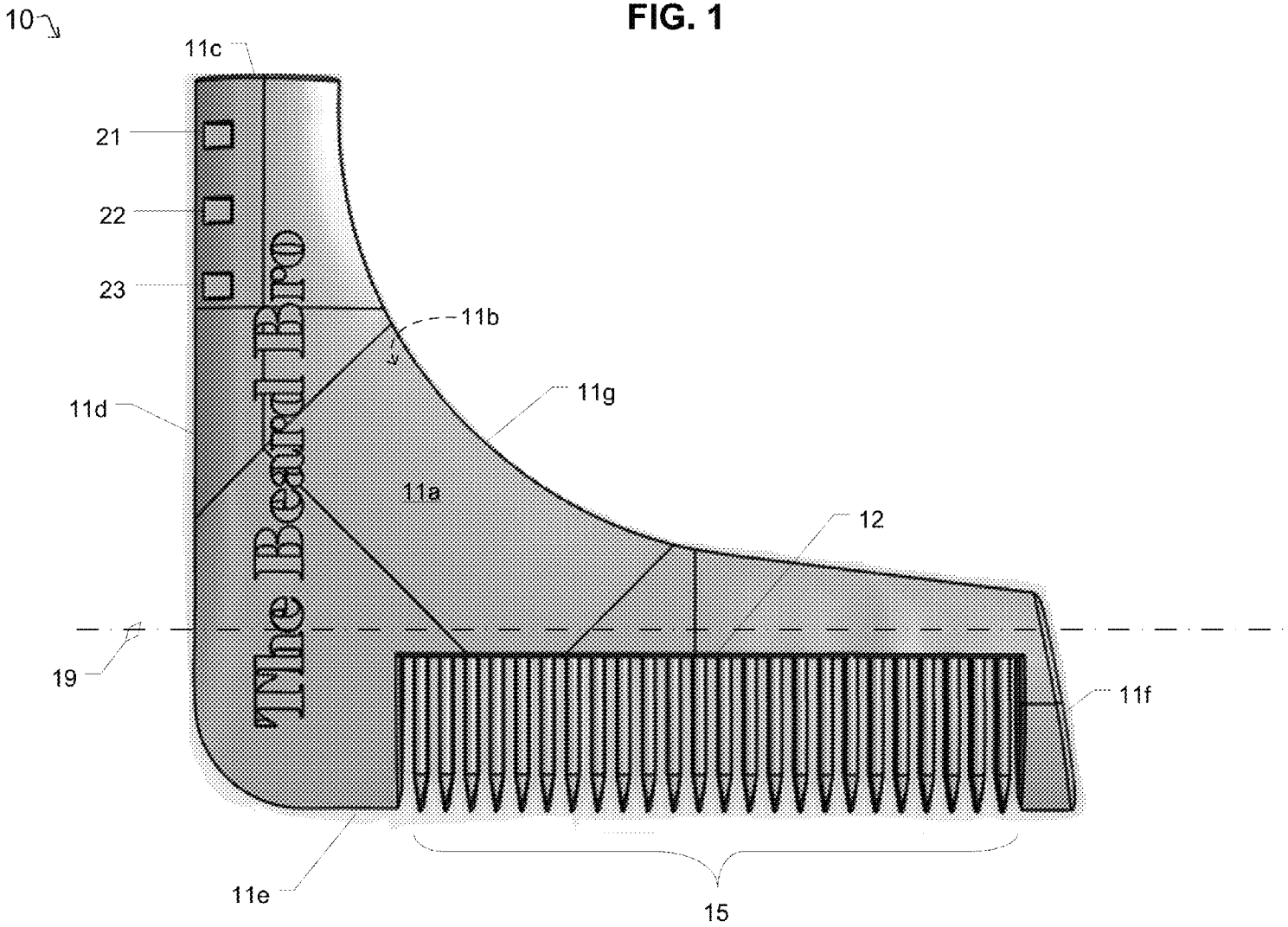
FIG. 1 is a frontal view of the facial hair shaping tool that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Figure 2:
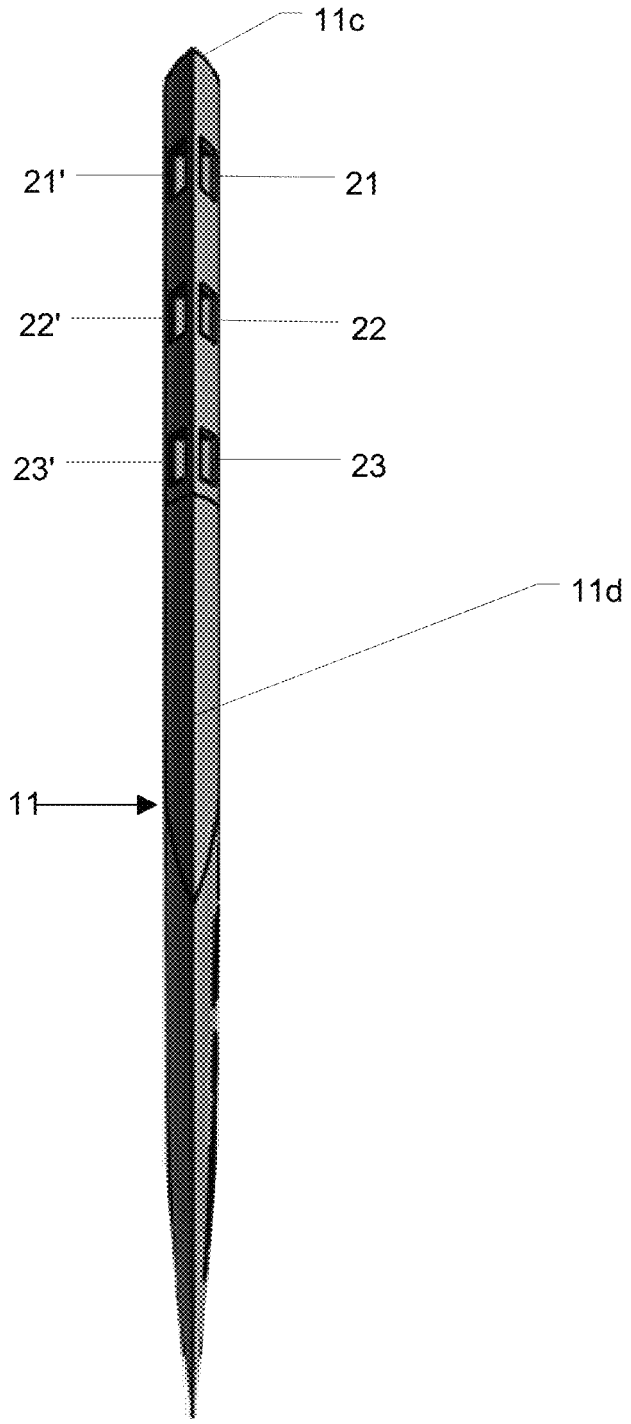
FIG. 2 is a side profile view of the facial hair shaping tool, in accordance with one embodiment of the invention.

FIGS. 1 and 2 illustrate one embodiment of a facial hair shaping tool 10, that is useful for understanding the inventive concepts disclosed herein. As shown, the tool 10 can include, essentially, a generally L-shaped main body member 11 having a plurality of spaced apart teeth 15 cantileveredly disposed thereon.

The main body 11, can preferably include a generally L-shaped member having a front surface 11*a*, a back surface 11*b*, a top end 11*c*, an elongated planar first side 11*d*, an elongated bottom end 11*e*, a truncated second side 11*f*, and a curvilinear central section 11*g* that extends from the second side 11*f* to the top end 11*c*.

As described herein, the main body can be constructed from any number of lightweight, semi-rigid and water resistant materials, such as injection molded plastic, for example, and can include any number of different sizes and/or thicknesses, based on the intended use and operation of the same, so as to conform to the shape of an adult human face as described below. The main body can include any number of different colors and markings, and can also be constructed from a generally transparent material so as to be see-through in nature.

The device 10 can also include one or more comb members that are disposed along one or more edges of the main body. In the preferred embodiment, the bottom end of the main body 11*e* can include a recessed longitudinal edge 12 for receiving a plurality of spaced apart combing teeth 15. Each of the teeth 15 can be cantileveredly mounted to the longitudinal edge 12 of the main body. In the preferred embodiment, each of the combing teeth 15 can include a generally elliptical cross-section which can smoothly interact with facial hair, and can be mounted perpendicular to the longitudinal axis 19 of the main body.

To this end, each of the teeth 15 can be constructed from an identical material as the main body, so as to allow the entire device 10 to be constructed as a unitary element. Of course, other embodiments are contemplated wherein the teeth are constructed from a different material and/or a different construction methodology is utilized. Moreover, although illustrated as including a plurality of in-line teeth, other embodiments are contemplated wherein the teeth are mounted in a manner so as to provide multiple rows of teeth that are aligned in a generally parallel orientation to each other.

Although illustrated as including one comb member along the longitudinal axis and 11*e*, this is but one possible implementation of the device. To this end, such elements can be located along any of the other sides of the main body such as the top end 11*c*, the first side 11*d*, the truncated second side 11*f*, and/or the curvilinear central section 11*g*, in addition to the illustrated location of 11*e*, or instead of 11*e*. As such, additional comb elements (e.g., recessed edges 12 and teeth 15), can be provided along multiple sides of the main body, without limitation.

In the preferred embodiment, each side of the device 11*c*, 11*d*, 11*e* and 11*f* can include an outer edge having a cross-sectional thickness that tapers to form a pointed tip along the entire edge (See FIG. 2) with regard to the front and back surfaces 11*a* and 11*b*. Such a tapered surface allows each edge of the device to be located against the skin of a user, and advantageously provides a more precise and contoured guide line for a razor or other shaving instrument, especially when compared to using a guide having a blunt edge.

As shown best in FIG. 2, the device 10 can also include a plurality of alignment markers 21, 22, 23, and 21', 22' 23', which can be secured along the front and back surfaces 11*a* and 11*b*, respectively as mirror elements of each other. Each of the markers can be located adjacent to the elongated planar first side 11*d*, and can preferably comprise a series of indentations and/or protrusions that are embedded within the respective surfaces of the main body. Such a feature can allow a user to easily and quickly locate and identify each alignment marker by touch. By providing such markers, a user can accurately measure distances from the top surface 11*c*, thereby providing symmetry on both sides of the face for allowing users to trim the length of their sideburns with each use. Of course, additional markings can be provided at other locations along the main body and/or the markings can be used for other purposes.

As will be described below in detail, the tool 10 is specifically designed to facilitate the trimming and styling of facial hair. As such, the shape of the main body 11 is advantageously designed to accommodate the shape of an average male head. Therefore, in the preferred embodiment, the main body can include a thickness (e.g., distance between the front surface 11*a* and back surface 11*b*) of approximately 2.25 mm, the top end 11*c* can include a length (along the longitudinal axis) of approximately 18.5 mm, the first side 11*d* can include a height (e.g., distance from the bottom end 11*e* to the top end 11*c*) of approximately 95 mm, the bottom end 11*e* can include a length of approximately 115 mm, the second side 11*f* can include a height (e.g., distance from the bottom end 11*e* to the central section 11*g*) of approximately 28.7 mm, and the curvilinear central section 11*g* can include a curve radius of approximately 58 mm.

Likewise, the first alignment markers on each of the front and back surfaces 21 and 21' can be located at a distance of approximately 6 mm from the top end 11*c*, and each of the second and third alignment markers 22-22' and 23-23', respectively, can include a separation distance of 6 mm from one another. Each of the spaced apart teeth 15 can preferably include a length of approximately 20.5 mm. The tapered edges can preferably include a thickness of between approximately 1 and 5 millimeters, for example.

Although described above as including a specific construction material, shape and dimensions, other embodiments are contemplated having different construction material(s), shape(s) and/or dimensions.

FIGS. 3A-6 illustrate various embodiments of the above described facial hair shaping tool 10 in operation, and several exemplary methods for utilizing the same.

Figure 3B:
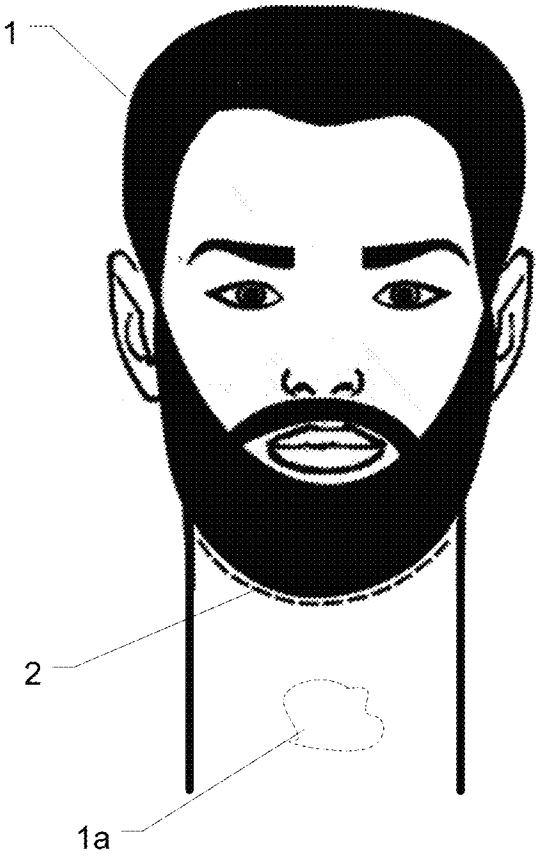
FIG. 3B is a front side view of a user of the facial hair shaping tool after utilizing the same.
Figure 3A:
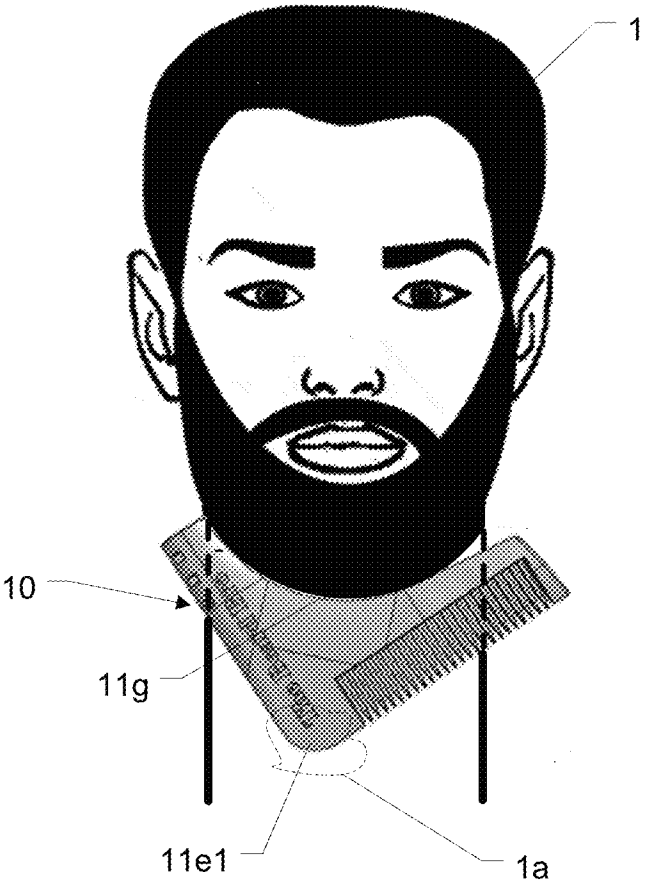
FIG. 3A is a front side view of the facial hair shaping tool in operation, in accordance with one embodiment of the invention.

As shown in FIGS. 3A and 3B, a user 1 can utilize the facial hair shaping tool 10 to assist in shaving the front of his neck, so as to form a clean and precise neck line 2. As shown, the user can position the tapered edge of the curvilinear central section 11*g* beneath his jaw at a location where he wishes his beard to be trimmed. In the illustrated example, the user can position the device 10 onto his neck with the front facing portion of the tool 11*a* in front his Adam's apple 1*a*. Next, the user can slide the tool back along the bottom of his jaw until the back surface of the tool is resting against his neck, and the curved bottom edge 11*e*1 is in contact against, or slightly above the Adam's apple. When so positioned, the user can shave, trim or otherwise sculpt the hair along the curved edge of the tool 11*g* from side to side, thereby creating a perfectly symmetrical neck line 2.

Figure 4:
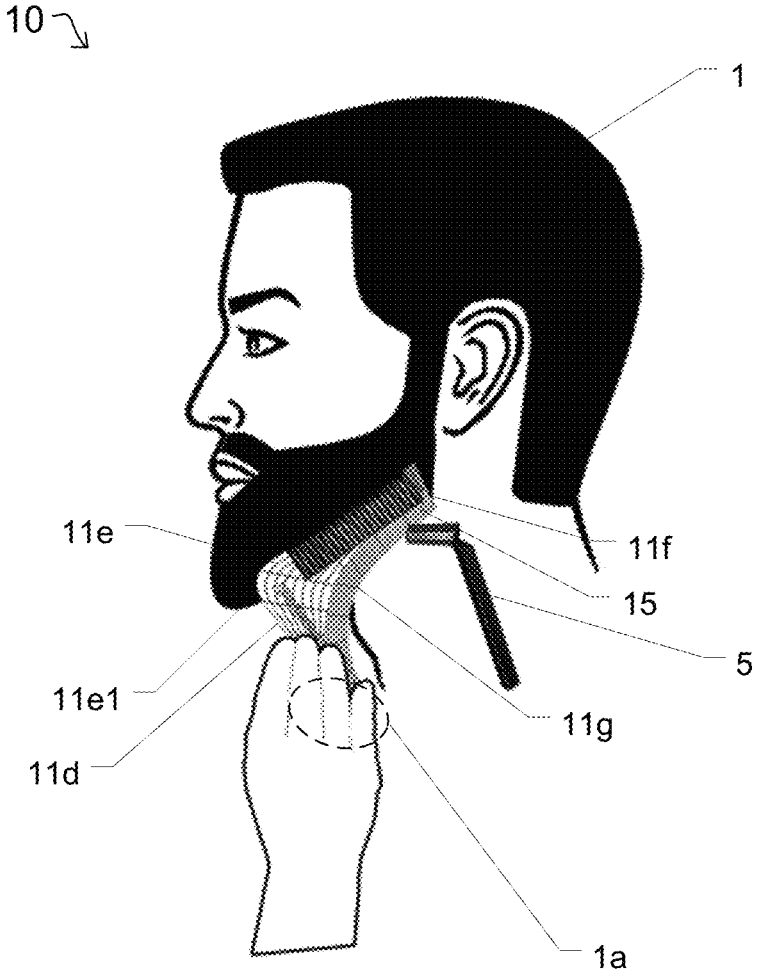
FIG. 4 is a side view of the facial hair shaping tool in operation, in accordance with one embodiment of the invention.

As shown in FIG. 4, the user 1 can utilize the facial hair shaping tool 10 to create a symmetric jaw line along each side of his face. As shown, the tool 10 can be placed in an inverted orientation with the combing teeth 15 in contact with the users beard, the truncated second side 11*f* against the back portion of the users jaw (adjacent to the ear), and the first side 11*d* extending downward in a parallel orientation with the users neck. When so positioned, the user can align one of the markers with his Adams apple 1*a*, and can utilize a razor 5 or other such cutting device to shave along the curvilinear edge 11*g*, thereby creating a clean and symmetrical jaw line. Moreover, when so positioned, the user can trim the length of his beard by shaving over the hairs that extend through the combing teeth 15. This process can be repeated to shave both sides of the users face in a completely symmetrical manner.

Figure 5:
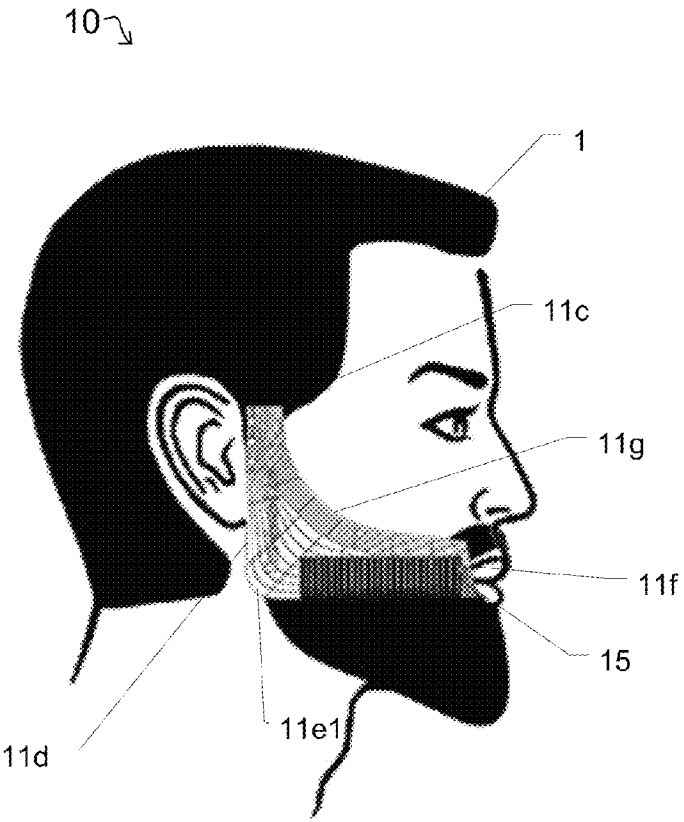
FIG. 5 is another front side view of the facial hair shaping tool in operation, in accordance with one embodiment of the invention.

As shown in FIG. 5, the user 1 can also utilize the facial hair shaping tool 10 to shape his beardcheek line. To this end, the user can position the main body against the side of his face, wherein the top end 11*c* is against his sideburn and the first side 11*d* parallel to his ear. At this time, the combing teeth 15 will be in contact with the users beard for trimming as described above, and user can utilize a razor or other such cutting device to shave along the curvilinear edge 11*g*, thereby creating a clean and symmetrical beardcheek line.

Figure 6:
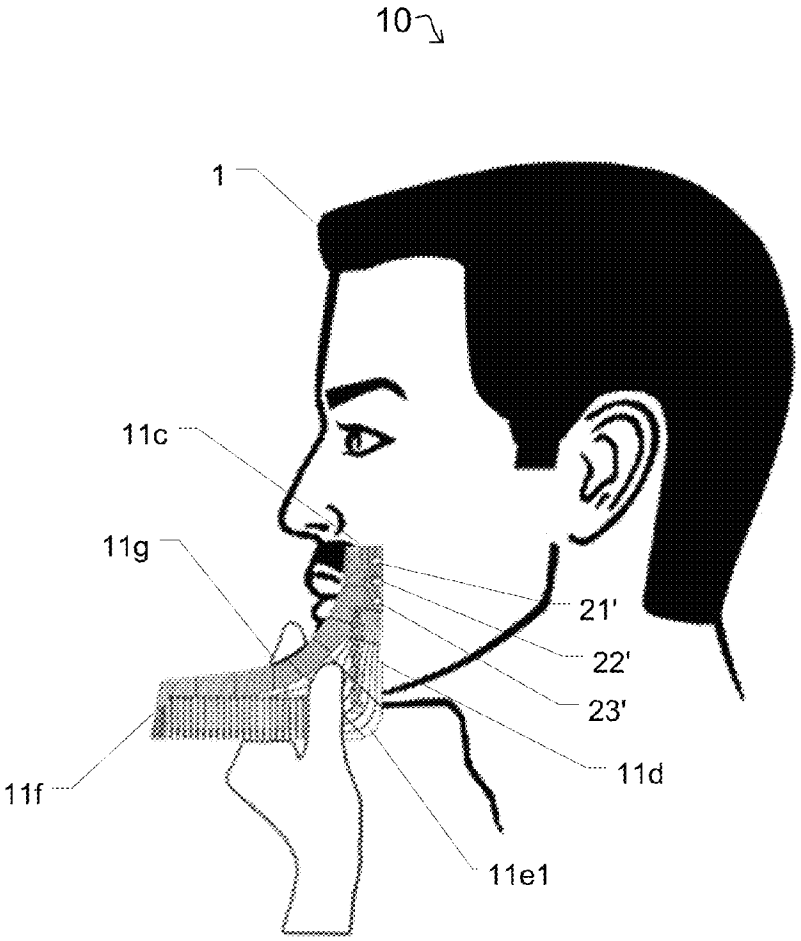
FIG. 6 is yet another front side view of the facial hair shaping tool in operation, in accordance with one embodiment of the invention.

Finally, as shown in FIG. 6, the user 1 can utilize the facial hair shaping tool 10 to shape his goatee. As shown, the user can align the corner 11*e*1 against the forward portion of his jaw and the top end 11*c* extending upward along the side of his mouth. At this time, the user can utilize a razor or other such cutting device to shave along the length of the first side 11*d*, thereby creating a clean and symmetrical goatee line. As further shown, the user can also utilize any of the alignment markers 21'-23', to adjust how high they wish to trim. This process can be utilized on both sides of the goatee with the corresponding markers 21-23, respectively, to ensure a symmetrical shape and cut on both sides.

Although described above with regard to particular uses and/or method steps, these are intended to be exemplary, as opposed to limiting in nature. As such, the facial hair shaping tool can be used any number of different ways for allowing users to shave and/or sculpt facial hair.

As described herein, one or more elements of the facial hair shaping tool 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements such as the main body 11 and the combing teeth 15, for example, may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A facial hair shaping tool, comprising:

a unitary and generally L-shaped main body that includes a front surface, a back surface, a top end, an elongated straight-planar first side, an elongated bottom end, a truncated second side, and a curvilinear central section, said central section extending from the second side to the top end;

each of the elongated straight-planar first side, the elongated bottom end, and the curvilinear central section including an outer edge having a cross-sectional thickness that is tapered to form a pointed tip along an entirety thereof; and a plurality of markers that are disposed along at least one of the top end, the elongated straight-planar first side, the elongated bottom end, the truncated second side, and the curvilinear central section, each of the plurality of markers comprising an indentation that is embedded within the main body, and said plurality of markers including a first marker and a second marker that are arranged in a mirror image to each other along the front surface and the back surface of the main body, wherein the curvilinear central section includes a shape and dimension that is configured to conform to a neckline of an adult user, the elongated bottom end includes a dimension that is configured to conform to a jawline of an adult user, and each of the straight-planar first side and the elongated bottom end include a shape and dimension that is configured to conform to a beardcheek line of an adult user.

2. The tool of claim 1, further comprising:

at least one comb element that is positioned along the main body.

3. The tool of claim 2, wherein each of the at least one comb element comprises:

a recession that is disposed along at least one of the top end, the elongated straight-planar first side, the elongated bottom end, the truncated second side, and the curvilinear central section; and a plurality of combing teeth that are positioned within the recession.

4. The tool of claim 3, wherein a top wall of the recession comprises a longitudinal edge.

5. The tool of claim 4, wherein each of the plurality of combing teeth are cantileveredly mounted to the longitudinal edge.

6. The tool of claim 3, wherein each of the plurality of combing teeth include an elliptical cross-section.

7. The tool of claim 1, wherein the plurality of markers include:

three evenly spaced indentations that are positioned along the front surface of the main body at a location adjacent to the elongated straight-planar first side.

8. The tool of claim 1, wherein the plurality of markers include:

three evenly spaced indentations that are positioned along the back surface of the main body at a location adjacent to the elongated straight-planar first side.

9. The tool of claim 1, wherein the plurality of markers comprises:

a first plurality of markers that are positioned along the front surface of the main body at a location adjacent to the elongated straight-planar first side, a second plurality of markers that are positioned along the back surface of the main body at a location adjacent to the elongated straight-planar first side, each of the first plurality of markers and second plurality of markers being evenly spaced apart from one another.

10. The tool of claim 1, wherein the plurality of markers comprise:

three evenly spaced indentations that are positioned along the front surface of the main body at a location adjacent to the outer edge of the elongated straight-planar first side; and three evenly spaced indentations that are positioned along the back surface of the main body at a location adjacent to the outer edge of the elongated straight-planar first side.

11. The tool of claim 1, wherein the plurality of markers comprise:

three evenly spaced indentations that are positioned along the front surface of the main body at a location adjacent to the elongated straight-planar first side; and three evenly spaced indentations that are positioned along the back surface of the main body at a location adjacent to the elongated straight-planar first side.

12. The tool of claim 1, wherein the plurality of markers consist of:

three spaced apart indentations that are positioned along the front surface of the main body; and three spaced apart indentations that are positioned along the back surface of the main body.

* * * * *